US010472141B2

(12) United States Patent
Wang

(10) Patent No.: US 10,472,141 B2
(45) Date of Patent: Nov. 12, 2019

(54) FILM TYPE WET TISSUE TUBE

(71) Applicant: Top Green World Packaging Co., Ltd., Shanghai (CN)

(72) Inventor: Ling-da Wang, Shanghai (CN)

(73) Assignee: TOP GREEN WORLD PACKAGING CO., LTD., Shanghai (CN)

( * ) Notice: Subject to any disclaimer, the term of this patent is extended or adjusted under 35 U.S.C. 154(b) by 0 days.

(21) Appl. No.: 15/969,499

(22) Filed: May 2, 2018

(65) Prior Publication Data

US 2019/0177056 A1 Jun. 13, 2019

(30) Foreign Application Priority Data

Dec. 7, 2017 (CN) ..... 2017 1 1286727

(51) Int. Cl.

| | |
|---|---|
| ***B65D 51/22*** | (2006.01) |
| ***B65D 43/16*** | (2006.01) |
| ***B65D 77/20*** | (2006.01) |
| ***B65D 83/08*** | (2006.01) |
| ***B65D 75/58*** | (2006.01) |

(52) U.S. Cl.

CPC ..... *B65D 51/22* (2013.01); *B65D 43/162* (2013.01); *B65D 75/5883* (2013.01); *B65D 77/20* (2013.01); *B65D 83/08* (2013.01); *B65D 83/0805* (2013.01); *B65D 2251/009* (2013.01); *B65D 2251/0021* (2013.01); *B65D 2543/00092* (2013.01); *B65D 2543/00518* (2013.01); *B65D 2543/00546* (2013.01); *B65D 2577/2091* (2013.01)

(58) Field of Classification Search

USPC ..... 220/258.2; 206/494, 233, 581, 810; 221/45, 63; 215/243; 383/42, 59

See application file for complete search history.

(56) References Cited

U.S. PATENT DOCUMENTS

| | | | | |
|---|---|---|---|---|
| 6,578,731 | B1 * | 6/2003 | Lewis | A47K 10/3818 221/46 |
| 6,702,109 | B1 * | 3/2004 | Tabuchi | B65D 75/5838 206/233 |
| 7,556,175 | B2 * | 7/2009 | Simkins | A47K 10/3818 206/409 |
| 7,850,044 | B2 * | 12/2010 | Hildebrand | B65D 75/5883 222/107 |

(Continued)

*Primary Examiner* — J. Gregory Pickett
*Assistant Examiner* — Tia Cox
(74) *Attorney, Agent, or Firm* — Muncy, Geissler, Olds & Lowe, P.C.

(57) ABSTRACT

A film type wet tissue tube, comprising a wet tissue cover and a wet tissue bag. The wet tissue bag is made of plastic film and hermetically connected below the wet tissue cover in a replaceable manner. By replacing existing injection molding tubes with the wet tissue bag made of plastic film, wet tissue bags of different types can be connected and replaced with the same wet tissue cover as a bag mouth of the wet tissue bag can be adjusted at the time of connection according to the size of the wet tissue cover. This meets the needs of users to change wet tissue bags at any time. This is both environmentally friendly and economical. The plastic film has low cost and thus lowers costs of raw materials and costs in the wet tissue manufacturing process, making the product more competitive in the market.

5 Claims, 2 Drawing Sheets

(56) References Cited

U.S. PATENT DOCUMENTS

| | | | | |
|---|---|---|---|---|
| 7,997,444 | B2 * | 8/2011 | Martins | B65D 83/0805 221/63 |
| 9,520,150 | B2 * | 12/2016 | Motsch | B65D 75/563 |
| 2004/0222119 | A1 * | 11/2004 | Alexander | B65D 83/0805 206/494 |
| 2005/0205594 | A1 * | 9/2005 | Evans | A47K 10/3818 221/63 |
| 2009/0057329 | A1 * | 3/2009 | Clough | A47K 10/421 221/33 |
| 2009/0308777 | A1 * | 12/2009 | Banik | B65D 83/0805 206/494 |
| 2010/0021089 | A1 * | 1/2010 | Arvizu | B65D 47/243 383/42 |
| 2013/0202228 | A1 * | 8/2013 | Murray | B65G 47/61 383/42 |
| 2014/0190983 | A1 * | 7/2014 | Sanguinet | A47K 10/3818 221/63 |
| 2014/0291343 | A1 * | 10/2014 | Neitzel | B65D 83/0805 221/63 |

* cited by examiner

FILM TYPE WET TISSUE TUBE

FIELD OF THE INVENTION

The present invention relates to a wet tissue tube, in particular to a film type wet tissue tube with a wet tissue bag at the bottom thereof replaceable optionally depending on needs.

DESCRIPTION OF THE RELATED ART

The existing wet tissue tubes are made up of wet tissue covers and tubes, and it is verified in the long-term use that such design has the following defects:

1. Wet tissue tubes are made by injection molding processes. All tubes are molded into a fixed size and shape at a time, and directly sealed with wet tissue covers after wet tissues are loaded therein. Such wet tissue tubes are sized, thus the wet tissue tubes can only be loaded with a fixed amount of wet tissues, the volume size thereof cannot be changed according to needs of users, and wet tissue capacity cannot be changed. To match up tubes, wet tissue covers cannot be used repeatedly for different types of tubes.

2. For manufacturers, the costs of wet tissue tubes made by injection molding processes are relatively high.

SUMMARY OF THE INVENTION

In order to solve the problem in the prior art, the present invention provides a film type wet tissue tube to address the problems of unchangeable wet tissue capacity, troublesome replacement and high production cost of wet tissue tubes.

The present invention solves the problems by the following technical solutions:

A film type wet tissue tube, comprising a wet tissue cover and a wet tissue bag, said wet tissue bag being made of plastic film and hermetically connected below said wet tissue cover in a replaceable manner.

Preferably, said wet tissue bag is connected below said wet tissue cover in a replaceable manner by high frequency welding, high temperature welding or glue.

Preferably, said wet tissue cover comprises an upper flap cover and a lower withdrawal cover integrally formed by an elastic material, said upper flap cover is connected with said lower withdrawal cover through a connecting rod, and is able to cover and seal said lower withdrawal cover.

Preferably, a connecting portion with threads on an outer surface thereof is arranged at a lower end of said lower withdrawal cover, and said connecting portion is hermetically connected with an upper opening of said wet tissue bag Preferably, two symmetrical projections are formed on a surface of said connecting portion.

Preferably, a raised upper ring wall is formed on a surface of said upper flap cover, and an edge of said upper flap cover is indented inward to form an opening portion; a raised inner ring wall and a raised outer ring wall are formed on an upper surface of said lower withdrawal cover, a gap is reserved between said inner ring wall and said outer ring wall for insertion of said upper ring wall, and a depressed open space is formed at said outer ring wall corresponding to said opening portion, so that a finger can insert to toggle said opening portion.

Preferably, a withdrawal opening is formed on an upper surface of said lower withdrawal cover, a sealing cover for sealing the withdrawal opening is arranged on said withdrawal opening, a tear lead and a force application portion are etched on said sealing cover, said sealing cover is removed along said tear lead after a force is applied to said force application portion, and breaks away from said lower withdrawal cover.

With the technical means, the present application improves structures of the wet tissue cover and the tube. By replacing existing injection molding tubes with the wet tissue bag made of plastic film, wet tissue bags of different types can be connected and replaced with the same wet tissue cover as a bag mouth of the wet tissue bag can be adjusted at the time of connection according to the size of the wet tissue cover, meeting the needs of users to change wet tissue bags at any time, which is both environmentally friendly and economical; meanwhile, the plastic film has low cost and thus lowers costs of raw materials and costs in the wet tissue manufacturing process, making the product more competitive in the market.

DESCRIPTION OF THE PREFERRED EMBODIMENT

The technical solution of the present invention will be further described in detail in combination with examples and drawings.

Figure 3:
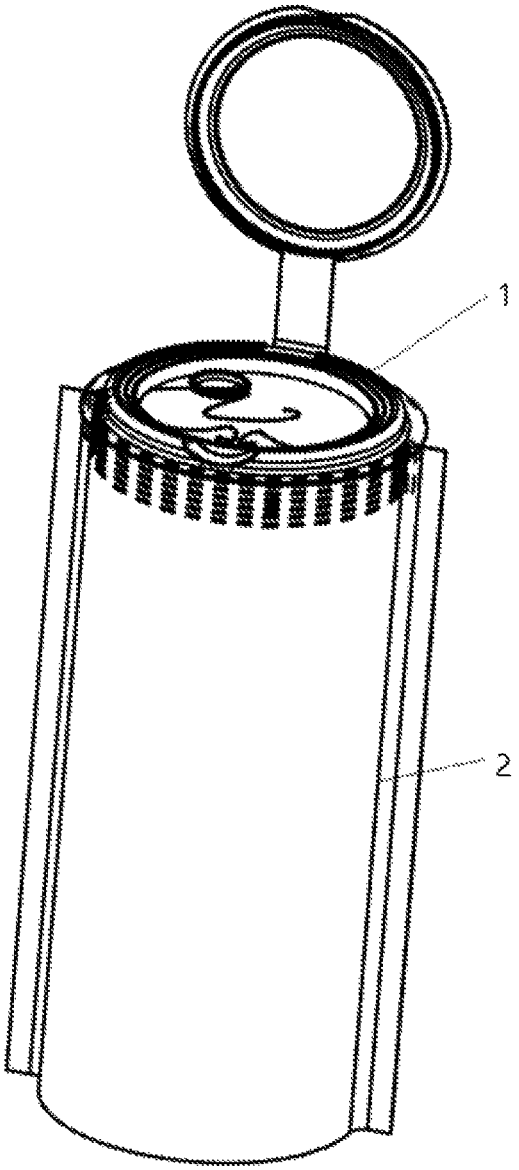
FIG. 3 is a structural diagram of an example of a film type wet tissue tube of the present invention.

As shown in FIG. 3, FIG. 3 is a structural diagram of an example of a film type wet tissue tube of the present invention. In the example, the film type wet tissue tube comprises a wet tissue cover 1 and a wet tissue bag 2, and said wet tissue bag 2 is made of plastic film and hermetically connected below said wet tissue cover 1 in a replaceable manner. Distinguished from tubes of fixed size and wet tissue covers that cannot match various types of tubes in the prior art, the wet tissue bag of the application is made of film, can be piled up or elastically pulled, and can be adapted to different types of wet tissue covers.

The wet tissue bag 2 of the present application is connected below said wet tissue cover 1 in a replaceable manner by high frequency welding, high temperature welding or glue. The methods are very simple and easy to implement, and can be easily achieved by both manufacturers or consumers, and it is convenient to replace.

Figure 1:
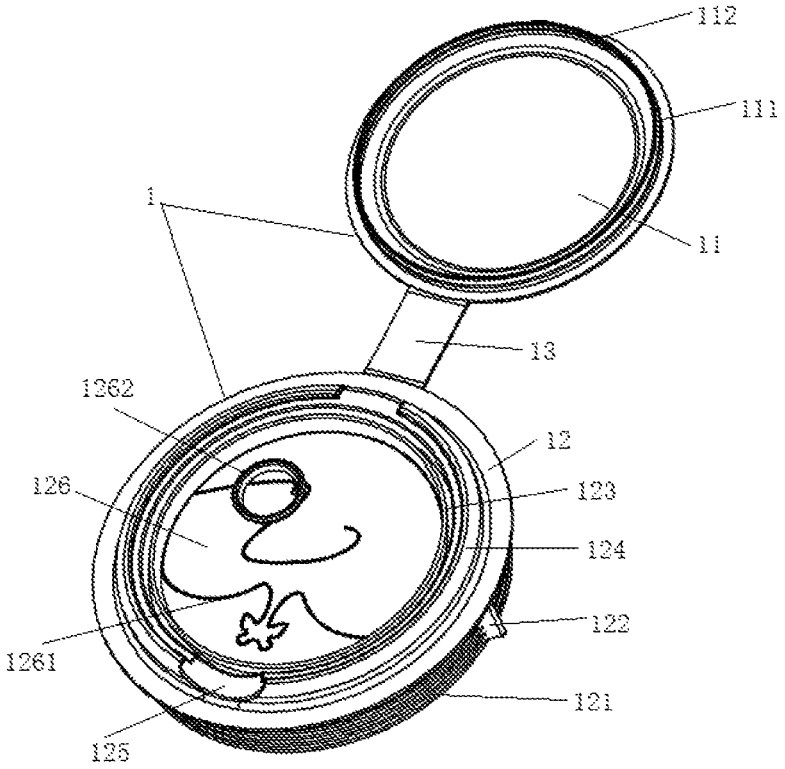
FIG. 1 is a structural diagram of an example of a wet tissue cover in an open state of the present invention.
Figure 2:
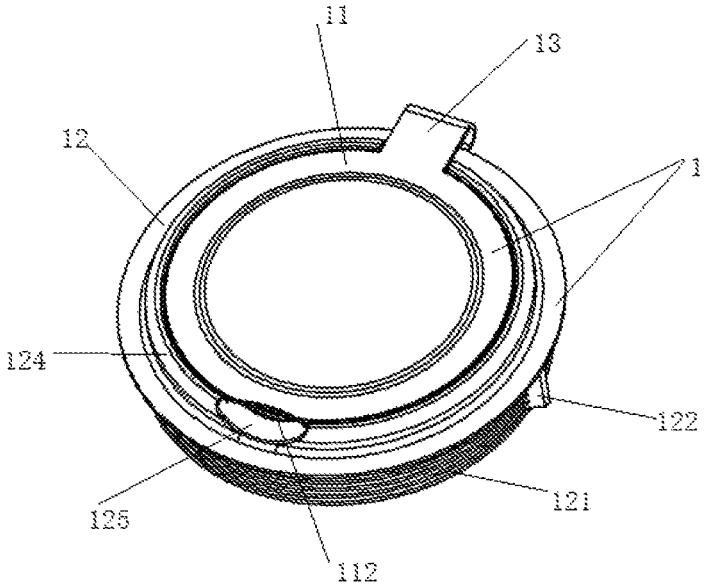
FIG. 2 is a structural diagram of an example of a wet tissue cover in a closed state of the present invention.

As shown in FIG. 1 and FIG. 2, FIG. 1 is a structural diagram of an example of a wet tissue cover in an open state of the present invention. FIG. 2 is a structural diagram of an example of a wet tissue cover in a closed state of the present invention. Said wet tissue cover 1 comprises an upper flap cover 11 and a lower withdrawal cover 12 integrally formed by an elastic material, said upper flap cover 11 is connected with said lower withdrawal cover 12 through a connecting rod 13, and is able to cover and seal said lower withdrawal cover 12. Based on FIG. 1 and FIG. 2, a connecting portion 121 with threads on an outer surface thereof is arranged at a lower end of said lower withdrawal cover 12, and said connecting portion 121 is hermetically connected with an upper opening of said wet tissue bag 2. The function of the threads is to strengthen the tightness of the connection and prevent water leakage between the wet tissue bag 2 and the connecting portion 121. In addition, two symmetrical projections 122 are formed on a surface of said connecting portion 121, the projections 122 can increase the area of connection, and provide more area for attachment of the wet tissue bag 2 when the wet tissue bag 2 is folded.

As shown in FIG. 1 and FIG. 2, a raised upper ring wall 111 is formed on a lower surface of said upper flap cover 11, and an edge of said upper flap cover 11 is indented inward to form an opening portion 112. A raised inner ring wall 123 and a raised outer ring wall 124 are formed on an upper surface of said lower withdrawal cover 12, and a gap is reserved between said inner ring wall 123 and said outer ring wall 124 for insertion of said upper ring wall 111, thus producing the effect of further seal. A depressed open space 125 is formed at said outer ring wall 124 corresponding to said opening portion 112, so that a finger can insert to toggle said opening portion 112.

A withdrawal opening is formed on an upper surface of said lower withdrawal cover 12, a sealing cover 126 for sealing the withdrawal opening is arranged on said withdrawal opening, a tear lead 1261 and a force application portion 1262 are etched on said sealing cover 126, said sealing cover 126 is removed along said tear lead 1261 after a force is applied to said force application portion 1262, and breaks away from said lower withdrawal cover 12.

To sum up, the application improves structures of the wet tissue cover and the tube. By replacing existing injection molding tubes with the wet tissue bag made of plastic film, wet tissue bags of different types can be connected and replaced with the same wet tissue cover as a bag mouth of the wet tissue bag can be adjusted at the time of connection according to the size of the wet tissue cover, meeting the needs of users to change wet tissue bags at any time, which is both environmentally friendly and economical; meanwhile, the plastic film has low cost and thus lowers costs of raw materials and costs in the wet tissue manufacturing process, making the product more competitive in the market.

Such embodiments are only used to describe the present invention, but not limit the scope thereof. Any equal changes and modifications made to the present invention by a person skilled in the art shall fall into the scope of claims attached to the present invention.

The invention claimed is:

1. A film type wet tissue tube, comprising a wet tissue cover and a wet tissue bag, said wet tissue bag being made of plastic film and hermetically connected below said wet tissue cover in a replaceable manner, wherein the wet tissue cover comprises an upper flap cover and a lower withdrawal cover integrally formed by an elastic material, said upper flap cover is connected with said lower withdrawal cover through a connecting rod, and is able to cover and seal said lower withdrawal cover, wherein a raised upper ring wall is formed on a surface of said upper flap cover, and an edge of said upper flap cover is indented inward to form an opening portion; a raised inner ring wall and a raised outer ring wall are formed on an upper surface of said lower withdrawal cover, a gap is reserved between said inner ring wall and said outer ring wall for insertion of said upper ring wall, and a depressed open space is formed at said outer ring wall corresponding to said opening portion, so that a finger can insert to toggle said opening portion.

2. The film type wet tissue tube according to claim 1, wherein the wet tissue bag is connected below said wet tissue cover in a replaceable manner by high frequency welding, high temperature welding or glue.

3. The film type wet tissue tube according to claim 1, wherein a connecting portion with threads on an outer surface thereof is arranged at a lower end of said lower withdrawal cover, and said connecting portion is hermetically connected with an upper opening of said wet tissue bag.

4. The film type wet tissue tube according to claim 3, wherein two symmetrical projections are formed on a surface of said connecting portion.

5. The film type wet tissue tube according to claim 1, wherein a withdrawal opening is formed on an upper surface of said lower withdrawal cover, a sealing cover for sealing the withdrawal opening is arranged on said withdrawal opening, a tear lead and a force application portion are etched on said sealing cover, said sealing cover is removed along said tear lead after a force is applied to said force application portion, and breaks away from said lower withdrawal cover.

* * * * *